US006501378B1

(12) United States Patent
Knaven

(10) Patent No.: US 6,501,378 B1
(45) Date of Patent: Dec. 31, 2002

(54) ITEM LOCATOR SYSTEM

(76) Inventor: Peter J. Knaven, 1924 Limerick Place, North Vancouver, BC (CA), V7J 3A1

( * ) Notice: Subject to any disclaimer, the term of this patent is extended or adjusted under 35 U.S.C. 154(b) by 0 days.

(21) Appl. No.: 09/965,734

(22) Filed: Sep. 27, 2001

(51) Int. Cl.[7] ..... G08B 1/08

(52) U.S. Cl. ..... 340/539; 340/571; 340/572.1; 340/573.2; 340/825.36; 340/825.49

(58) Field of Search ..... 340/539, 573.2, 340/686.6, 568.1, 568.6, 568.7, 571, 572.1, 825.36, 825.49

(56) References Cited

U.S. PATENT DOCUMENTS 4,101,873 A 7/1978 Anderson et al.
5,410,326 A 4/1995 Goldstein
5,677,673 A 10/1997 Kipnis
5,680,105 A 10/1997 Hedrick
D408,032 S 4/1999 Nagano et al.
5,939,981 A 8/1999 Renney
6,366,202 B1 * 4/2002 Rosenthal ..... 340/539

* cited by examiner

*Primary Examiner*—Daryl Pope

(57) ABSTRACT

A item locator system for locating lost personal articles. The item locator system includes a first device for receiving and transmitting a signal over free space. The first device includes a first transceiver adapted for sending a plurality of signals each has a distinct frequency. A microprocessor actuates the first transceiver and determining the distinct transmitted signal. The microprocessor is operationally coupled to the first transceiver. A speaker emits an audible sound, is operationally coupled to the microprocessor and actuated when the first transceiver receives a signal. A plurality of input actuators input information into the microprocessor and are operationally coupled to the microprocessor. A plurality of second devices receives and transmits signals over free space. Each of the second devices is adapted for receiving one of the distinct signals and transmitting a signal to the first transceiver. Each of the second devices is positionable on one of the articles.

8 Claims, 2 Drawing Sheets

ITEM LOCATOR SYSTEM

BACKGROUND OF THE INVENTION

1. Field of the Invention

The present invention relates to item locator devices and more particularly pertains to a new item locator system for locating lost personal articles.

2. Description of the Prior Art

The use of item locator devices is known in the prior art. More specifically, item locator devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,677,673; U.S. Pat. No. 5,939,981; U.S. Des. Pat. No. 408,032; U.S. Pat. No. 4,101,873; U.S. Pat. No. 5,680,105; and U.S. Pat. No. 5,410,326.

While these devices fulfill their respective, particular objectives and requirements, the aforementioned patents do not disclose a new item locator system. The inventive device includes a first device for receiving and transmitting a signal over free space, the first device includes a first transceiver adapted for sending a plurality of signals each has a distinct frequency. A control means actuates the first transceiver and determining the distinct transmitted signal. The control means is operationally coupled to the first transceiver. A speaker means for emitting an audible sound is operationally coupled to the control means and actuated when the first transceiver receives a signal. A plurality of input actuators input information into the control means and are operationally coupled to the control means. A plurality of second devices receives and transmits signals over free space. Each of the second devices is adapted for receiving one of the distinct signals and transmitting a signal to the first transceiver. Each of the second devices is positionable on one of the articles.

In these respects, the item locator system according to the present invention substantially departs from the conventional concepts and designs of the prior art, and in so doing provides an apparatus primarily developed for the purpose of locating lost personal articles.

SUMMARY OF THE INVENTION

In view of the foregoing disadvantages inherent in the known types of item locator devices now present in the prior art, the present invention provides a new item locator system construction wherein the same can be utilized for locating lost personal articles.

The general purpose of the present invention, which will be described subsequently in greater detail, is to provide a new item locator system apparatus and method which has many of the advantages of the item locator devices mentioned heretofore and many novel features that result in a new item locator system which is not anticipated, rendered obvious, suggested, or even implied by any of the prior art item locator devices, either alone or in any combination thereof.

To attain this, the present invention generally comprises a first device for receiving and transmitting a signal over free space, the first device includes a first transceiver adapted for sending a plurality of signals each has a distinct frequency. A control means actuates the first transceiver and determining the distinct transmitted signal. The control means is operationally coupled to the first transceiver. A speaker means for emitting an audible sound is operationally coupled to the control means and actuated when the first transceiver receives a signal. A plurality of input actuators input information into the control means and are operationally coupled to the control means. A plurality of second devices receives and transmits signals over free space. Each of the second devices is adapted for receiving one of the distinct signals and transmitting a signal to the first transceiver. Each of the second devices is positionable on one of the articles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new item locator system apparatus and method which has many of the advantages of the item locator devices mentioned heretofore and many novel features that result in a new item locator system which is not anticipated, rendered obvious, suggested, or even implied by any of the prior art item locator devices, either alone or in any combination thereof.

It is another object of the present invention to provide a new item locator system which may be easily and efficiently manufactured and marketed.

It is a further object of the present invention to provide a new item locator system which is of a durable and reliable construction.

An even further object of the present invention is to provide a new item locator system which is susceptible of a low cost of manufacture with regard to both materials and labor, and which accordingly is then susceptible of low prices of sale to the consuming public, thereby making such item locator system economically available to the buying public.

Still yet another object of the present invention is to provide a new item locator system which provides in the apparatuses and methods of the prior art some of the advantages thereof, while simultaneously overcoming some of the disadvantages normally associated therewith.

Still another object of the present invention is to provide a new item locator system for locating lost personal articles.

Yet another object of the present invention is to provide a new item locator system which includes a first device for receiving and transmitting a signal over free space, the first device includes a first transceiver adapted for sending a plurality of signals each has a distinct frequency. A control means actuates the first transceiver and determining the distinct transmitted signal. The control means is operationally coupled to the first transceiver. A speaker means for emitting an audible sound is operationally coupled to the control means and actuated when the first transceiver receives a signal. A plurality of input actuators input information into the control means and are operationally coupled to the control means. A plurality of second devices receives and transmits signals over free space. Each of the second devices is adapted for receiving one of the distinct signals and transmitting a signal to the first transceiver. Each of the second devices is positionable on one of the articles.

Still yet another object of the present invention is to provide a new item locator system that uses a plurality of second transceivers for positioning on different items and receiving different frequencies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
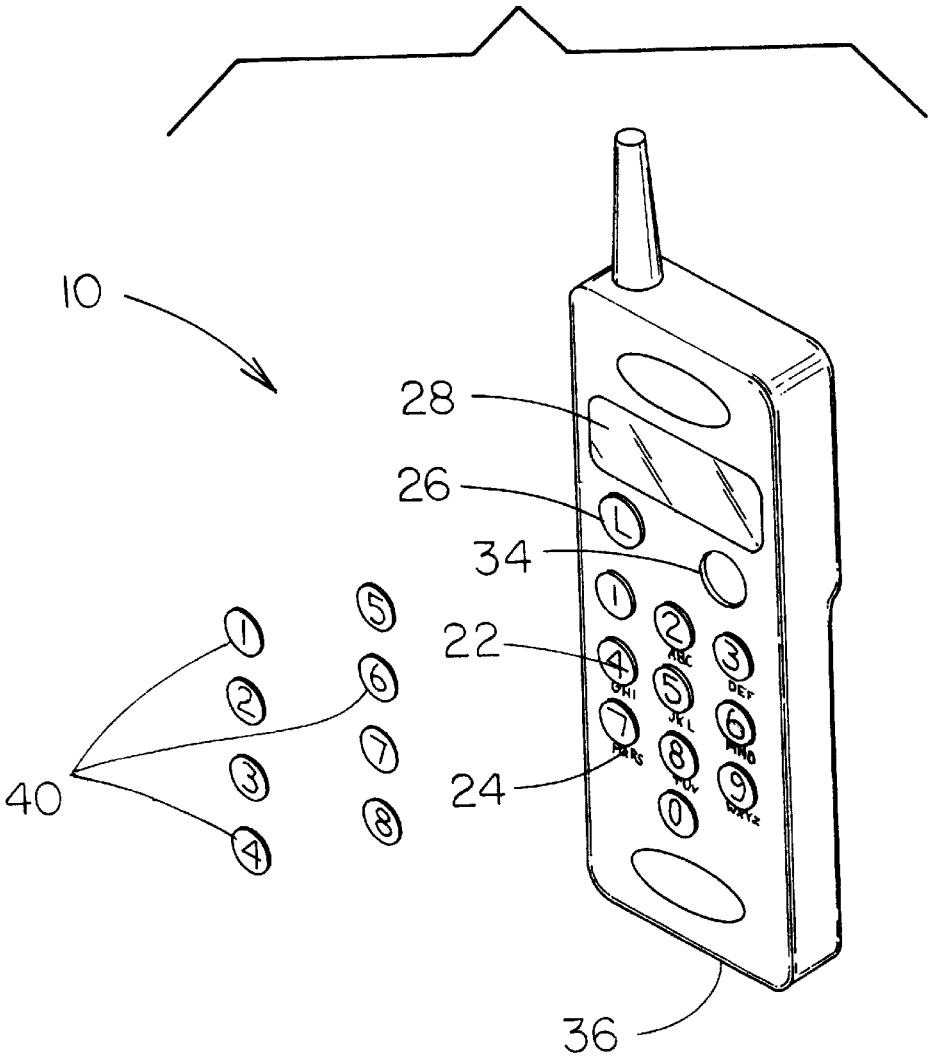
FIG. 1 is a schematic perspective view of a new item locator system according to the present invention.
Figure 2:
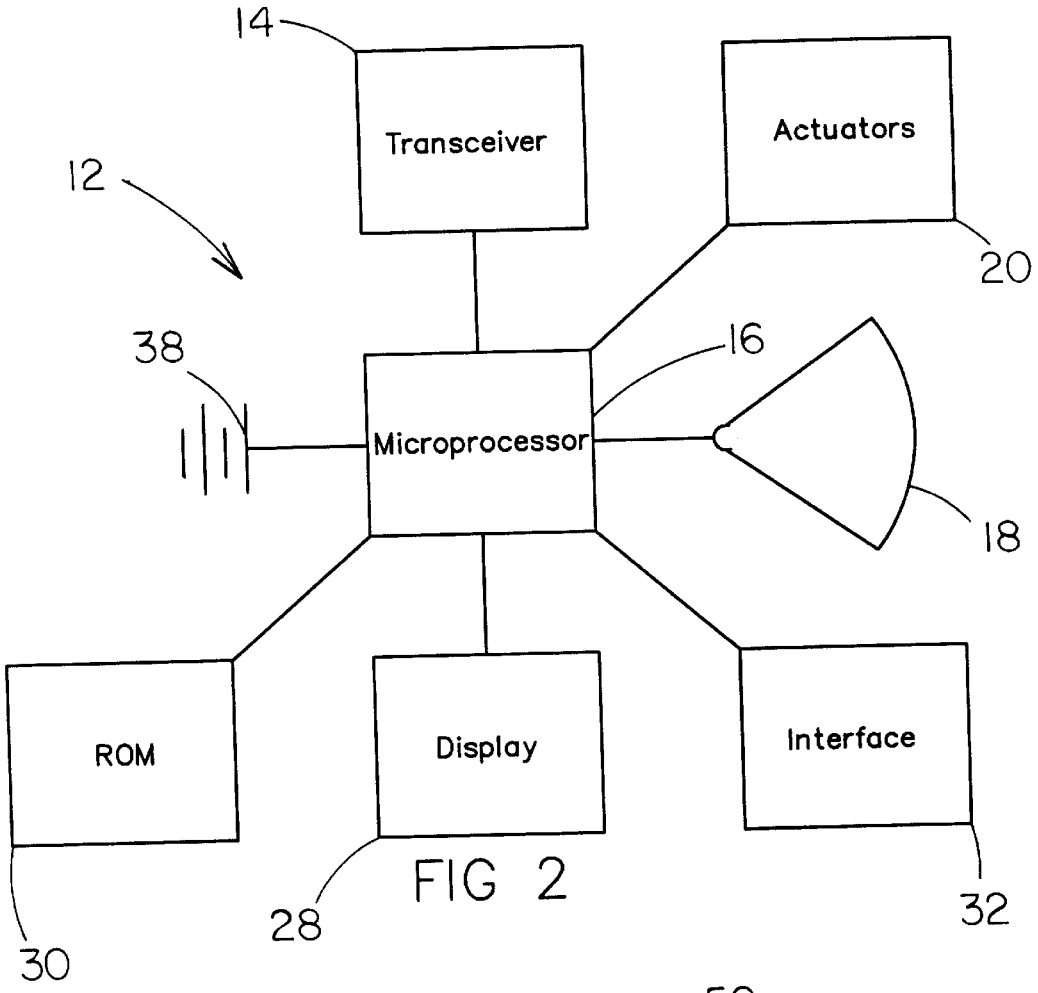
FIG. 2 is a schematic view of the first device of present invention.
Figure 3:
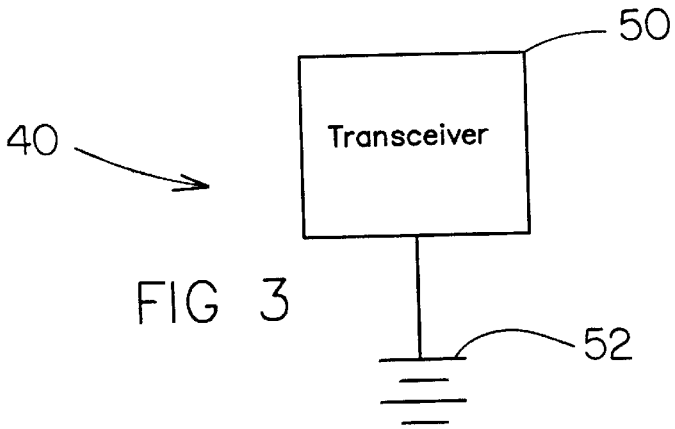
FIG. 3 is a schematic view of the second device of the present invention.

With reference now to the drawings, and in particular to FIGS. 1 through 3 thereof, a new item locator system embodying the principles and concepts of the present invention and generally designated by the reference numeral 10 will be described.

As best illustrated in FIGS. 1 through 3, the item locator system 10 generally comprises a first device 12 for receiving and transmitting a signal over free space. The first device 12 includes a first transceiver 14 adapted for sending a plurality of signals each having a distinct frequency. A control means 16 actuates the first transceiver 14 and determines the distinct signal to be transmitted. The control means 16 is operationally coupled to the first transceiver 14. The control means 16 preferably comprises a microprocessor. A speaker means 18 for emitting an audible sound is operationally coupled to the control means 16 and actuated when the first transceiver 14 receives a signal. The control means 16 is adapted for causing the speaker means 1 8 to emit a quickening pulsating sound as the signal received by the first transceiver becomes stronger and a slowing pulsating sound as the signal becomes weaker.

A plurality of input actuators 20 for inputting information into the control means 16 is operationally coupled to the control means 16. Each of input actuators 20 has number 22 and letter 24 indicia thereon. A first of the input actuators 26 is adapted for selectively turning the control means on or off.

A display means 28 for viewing inputted information. The display means 28 is operationally coupled to the control means 16 and preferably comprises a liquid crystal display.

A memory means 30 stores inputted information is operationally coupled to the control means 16. The memory means 30 is preferably ROM type memory.

An interface means 32 for interfacing a plurality of second transceivers 50 with the control means 16 is operationally coupled to the control means 16. The interface means 32 preferably being a slot 34 for receiving the second transceiver 50.

Ideally, also included is a communication means 36 for communicating over free space. The communication means 36 preferably comprises a cordless or cellular telephone. The mentioned elements of the first device 12 may be incorporated in a housing of the telephone. The telephone sharing the input actuators, display and speaker with the first device.

A power supply 38 for powering the control means 16 is operationally coupled to the control means 16. The power supply 38 preferably comprises a battery.

A plurality of second devices 40 receive and transmit signals over free space. Each of the second devices 40 is adapted for receiving one of the distinct signals from the first device 12. Each of the second devices 40 is positionable on one of a plurality of articles for locating the article. This may be done with a pressure sensitive adhesive. Each of the second devices 40 includes a second transceiver 50 having a transmitter adapted for sending signal to the first transceiver and a receiver adapted for turning the transmitter on when the receiver receives a signal from the first transceiver 14. A second power supply 52 for powering the second transceiver 50 is operationally coupled to the second transceiver 50 and comprises a battery.

In use, each of the second transceivers 50 is interfaced with the control means 16 via the interface means 32 such that each of the second transceivers 50 may be assigned a value based on an associated distinct signal. The value is stored in the memory means 30 along with selected indicia such that the control means 16 may cause the first transceiver 14 to send the associated distinct signal when that value is selected. The user also enters indicia using the actuators 20 to display a name associated with the value. The name would generally be the name of the article on which the second device will be positioned such as wallet, glasses, and remote control. The user activates the control means 16 and selects the value/name for the article which is lost. The speaker 18 then emits a pulsating sound which quickens as the user nears the lost article. In this manner, the article may be tracked and found. A cordless phone is the preferred embodiment as cordless phones typically have a location system built in so that the user may find their phone. If the user has the phone, that may then be used to find other articles with the system as disclosed above.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An article location system for locating a plurality of personal articles, said system comprising:

a first device for receiving and transmitting a signal over free space, said first device including;

a first transceiver adapted for sending a plurality of signals each having a distinct frequency;

a control means for actuating said first transceiver and determining said distinct transmitted signal, said control means being operationally coupled to said first transceiver, said control means comprising a microprocessor;

a speaker means for emitting an audible sound, said speaker means being operationally coupled to said control means and actuated when said first transceiver receives a signal, said control means being adapted for causing said speaker means to emit a quickening pulsating sound as said signal received by said first transceiver becomes stronger and a slowing pulsating sound as said signal becomes weaker;

a plurality of input actuators for inputting information into said control means and being operationally coupled to said control means, each of input actuators having number and letter indicia thereon, a first of said input actuators being adapted for selectively turning said control means on or off;

a display means for viewing inputted information, said display means being operationally coupled to said control means and comprising a liquid crystal display;

a memory means for storing inputted information, said memory means being operationally coupled to said control means;

an interface means for interfacing a plurality of second transceivers with said control means, said interface means being operationally coupled to said control means;

a communication means for communicating over free space, said communication means comprising a cordless telephone;

a power supply for powering said control means being operationally coupled to said control means, said power supply comprising a battery;

a plurality of second devices for receiving and transmitting signals over free space, each of said second devices being adapted for receiving one of said distinct signals, each of said second devices being positionable on one of said articles, each of said second devices comprising;

a second transceiver having a transmitter adapted for sending signal to said first transceiver and a receiver adapted for turning said transmitter on when said receiver receives a signal from said first transceiver;

a second power supply for powering said second transceiver being operationally coupled to said second transceiver and comprising a battery; and wherein each of said second transceivers is interfaced with said control means via said interface means such that each of said second transceivers may be assigned a value based on an associated distinct signal, wherein said value is stored in said memory means such that said control means may cause said first transceiver to send the associated distinct signal when a value is selected.

2. An article location system for locating a plurality of personal articles, said system comprising:

a first device for receiving and transmitting a signal over free space, said first device including;

a first transceiver adapted for sending a plurality of signals each having a distinct frequency;

a control means for actuating said first transceiver and determining said distinct transmitted signal, said control means being operationally coupled to said first transceiver;

a speaker means for emitting an audible sound, said speaker means being operationally coupled to said control means and actuated when said first transceiver receives a signal;

a plurality of input actuators for inputting information into said control means and being operationally coupled to said control means;

a plurality of second devices for receiving and transmitting signals over free space, each of said second devices being adapted for receiving one of said distinct signals and sending a signal to the first transceiver, each of said second devices being positionable on one of said articles; and said first device further including a display means for viewing inputted information from said control means when said input actuators are actuated, said display means being operationally coupled to said control means, said display means comprising a screen member being operationally coupled to said control means such that said screen member is for displaying inputted information to be viewed.

3. The article location system as in claim 2, wherein said control means is adapted for causing said speaker means to emit a quickening pulsating sound as said signal received by said first transceiver becomes stronger and a slowing pulsating sound as said signal becomes weaker.

4. The article location system as in claim 2, wherein a first of said input actuators being adapted for selectively turning said control means on or off.

5. The article location system as in claim 2, said first device further including a memory means for storing inputted information, said memory means being operationally coupled to said control means.

6. The article location system as in claim 5, further including:

an interface means for interfacing a plurality of second transceivers with said control means, said interface means being operationally coupled to said control means;

each of said second devices comprising;

a second transceiver having a transmitter adapted for sending signal to said first transceiver and a receiver adapted for turning said transmitter on when said receiver receives a signal from said first transceiver; and wherein each of said second transceivers is interfaced with said control means via said interface means such that each of said second transceivers may be assigned a value based on an associated distinct signal, wherein said value is stored in said memory means such that said control means may cause said first transceiver to send the associated distinct signal when a value is selected.

7. The article location system as in claim 6, further including a communication means for communicating over free space.

8. The article location system as in claim 2, further including a communication means for communicating over free space.

* * * * *